US005343976A

United States Patent [19]

Ostrobrod

[11] Patent Number: 5,343,976

[45] Date of Patent: Sep. 6, 1994

[54] SAFETY DEVICE

[76] Inventor: Meyer Ostrobrod, 2070 Bennett Rd., Philadephia, Pa. 19116

[21] Appl. No.: 25,461

[22] Filed: Mar. 3, 1993

[51] Int. Cl.[5] ..... B66D 1/06; A62B 35/04

[52] U.S. Cl. ..... 182/4; 182/237; 182/239

[58] Field of Search ..... 182/231-235, 182/236-240, 4

[56] References Cited

U.S. PATENT DOCUMENTS 4,489,919 12/1984 Ostrobrod ..... 182/234
4,511,123 4/1985 Ostrobrod ..... 182/234 X

FOREIGN PATENT DOCUMENTS 9211065 7/1992 PCT Int'l Appl. ..... 182/237

*Primary Examiner*—Alvin C. Chin-Shue

*Attorney, Agent, or Firm*—Norman E. Lehrer

[57] ABSTRACT

A safety device for preventing injuries to a worker as a result of a fall includes a housing which is intended to be mounted at an elevated position where the worker is working and a cable which is adapted to be connected to a harness or belt worn by the worker. The housing includes a spring driven drum therein which normally keeps the cable wound thereon but which allows the same to be withdrawn slowly from the housing as more cable is needed by the worker. A centrifugally operated brake senses an initial quick withdrawal of the cable from the housing which results from the worker falling and stops further withdrawal therefrom to thereby prevent the worker from falling further. A manually operated crank mechanism carried by the housing allows a fellow worker to raise or lower the fallen worker to safety.

20 Claims, 4 Drawing Sheets

SAFETY DEVICE

BACKGROUND OF THE INVENTION

The present invention is directed toward a safety device and, more particularly, toward a safety device which is intended to prevent a worker who is working in high places such as at the top of a building or on a bridge or the like from being injured in a fall. The device is similarly useful for protecting a worker who may be working in a confined space such as a sewer or tank or the like.

Safety devices of the class to which the present invention pertains and which protect a worker from injury or death caused by falling are generally known. These prior art devices, sometimes referred to as personal fall arrest systems, are used in conjunction with other components such as an anchoring means for the device and a body harness.

Such known devices are generally comprised of a housing which is adapted to be suspended from an elevated structure. A rope or cable winding drum is rotatably mounted in the housing and a spiral spring drives the drum in a direction which continuously tends to wind the cable around the drum. A centrifugally operated brake mechanism responds to an initial fast rotation of the drum in the unwinding direction and brakes the rotation of the drum to prevent further unwinding thereof.

In use, these known safety devices are fixed to a structure such as a building, bridge or the like and the cable extending therefrom is fastened to a worker's belt or harness. Under normal working conditions, i.e. as the worker moves from one place to another, and the rope is drawn in and out of the housing at a reasonable speed, the centrifugal brake is never engaged since the speed of rotation of the drum is relatively slow. Accordingly, the drum rotates freely and the rope is drawn out from or wound on the drum freely. In the event of a fall, however, the rope is drawn out rapidly and the drum is then rotated at a high speed. As a result, the centrifugally operated brake is actuated thereby preventing further rotation of the drum which stops the rope from being drawn out. This arrests the worker's fall and prevents injury or death to the worker which otherwise would occur as a result of the fall.

Previously available safety devices such as those described above have been extremely useful and do prevent serious injury and death to workers. However, they have all suffered from a common deficiency. When a worker has fallen and is being suspended by the rope from the safety device, additional lifting equipment was needed to lift the worker back up to safety.

Because of the elevated locations at which workers using such safety devices are normally working, it was often difficult and time consuming to get the necessary lifting equipment into place. In some situations, it may be possible for a worker to climb to safety. However, it is not uncommon for a worker to be slightly injured during the accident thereby making it difficult for him to lift himself to safety. A similar problem exists if the worker is working in a confined space such as a sewer, tank or the like and must be brought to the surface.

To alleviate the foregoing problem, safety devices have been constructed which incorporate therein a means such as a winch or the like for lifting a worker to safety after he has fallen. Such devices are shown, for example, in U.S. Pat. Nos. 4,489,919 and 4,511,123. In each case, the safety device functions in its normal manner as explained above but in the event of a fall, a normally inoperative lever or crank is engaged and the worker can be raised to safety by slowly turning the drum and winding the rope and cable thereon.

While these two prior patents do describe systems which go a long way to solve the problem of returning a worker to safety, there are many instances when they are still unsatisfactory. Although each of the two described patented systems is capable of lifting a fallen worker back up to the elevation from where he fell, this is not always desirable.

If the safety device is being used by a worker constructing a building, for example, it may not be desirable to lift the fallen worker back up to his initial elevated location. If the worker had been injured during the fall, it could be extremely difficult to then transport the worker back to the ground or to some other lower and safer location. It is desirable, therefore, to be able to either lift or lower a fallen or injured worker to a safer location. The device shown in U.S. Pat. No. 4,511,123 is not capable of lowering a worker. And while U.S. Pat. No. 4,489,919 does suggest such a system, it is wholly inadequate since it relies on the braking system of the safety device to prevent a fall while lowering rather than providing an additional braking means. This can be particularly dangerous if control of the handle is lost when the worker is only several feet from the ground since he may sustain further injuries before the main brake is activated.

SUMMARY OF THE INVENTION

The present invention is designed to overcome the deficiencies of the prior art described above. The invention is directed toward a safety device for preventing injuries to a worker as a result of a fall and includes a housing which is intended to be mounted at an elevated position where the worker is working and a cable which is adapted to be connected to a harness or belt worn by the worker. The housing includes a spring driven drum therein which normally keeps the cable wound thereon but which allows the same to be withdrawn slowly from the housing as more cable is needed by the worker. A centrifugally operated brake senses an initial quick withdrawal of the cable from the housing which results from the worker falling and stops further withdrawal therefrom to thereby prevent the worker from falling further. A manually operated crank mechanism carried by the housing allows a fellow worker to raise or lower the fallen worker to safety. An additional brake connected to the crank mechanism prevents further injury to the worker as he is being raised or lowered by providing controlled raising or lowering operations.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

FIG. 58 is a partial cross-sectional view taken along the line 5—5 of FIG. 1.

DETAILED DESCRIPTION OF THE PREFERRED EMBODIMENT

Figure 1:
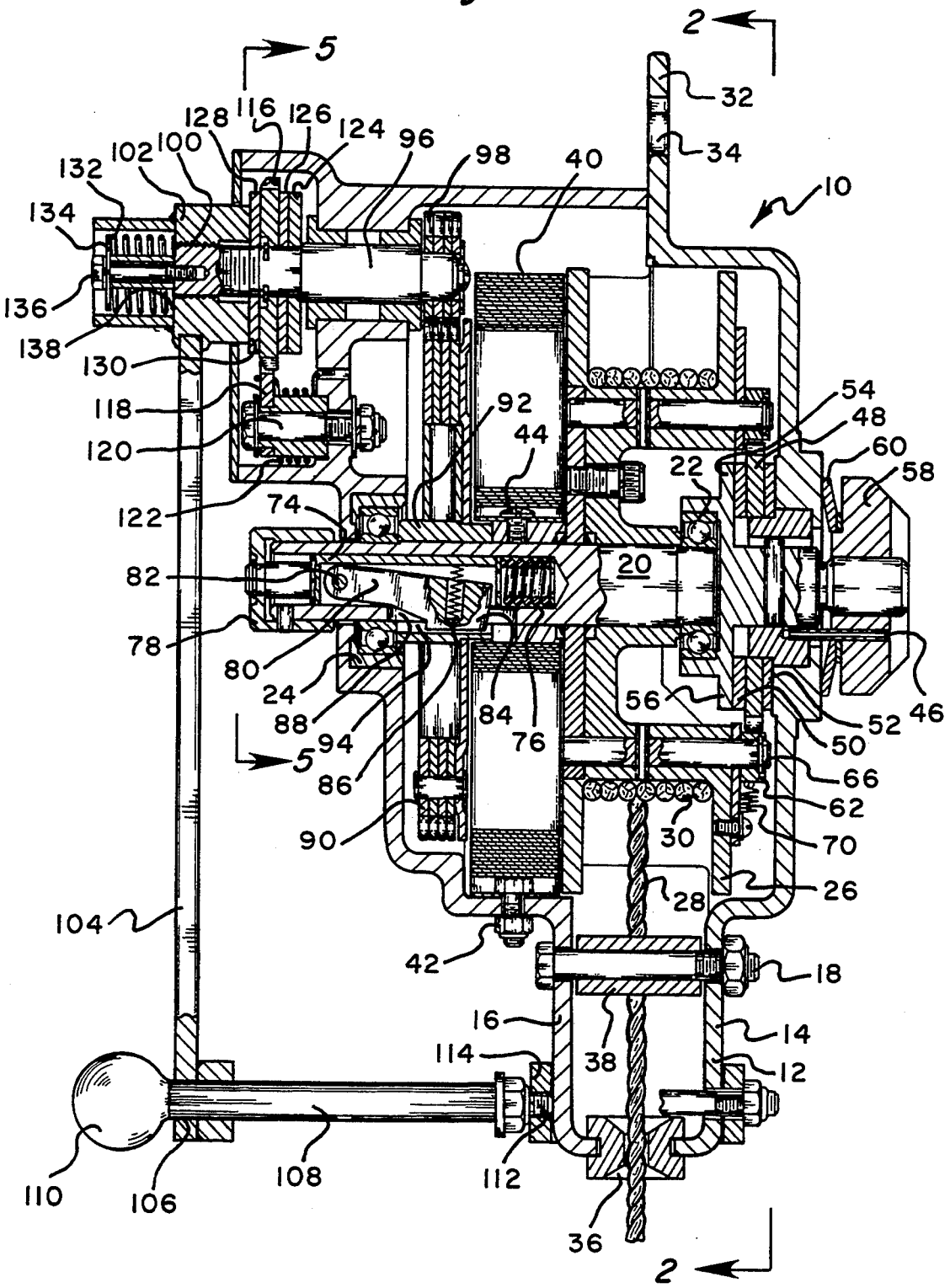
FIG. 1 is a cross-sectional view of a safety device of the invention.

Referring now to the drawings in detail wherein like reference numerals have been used throughout the various figures to designate like elements, there is shown in FIG. 1 a cross-sectional view of a safety device constructed in accordance with the principles of the present invention and designated generally as 10. The safety device 10 is comprised essentially of a case or housing 12 formed by joining the two complementary housing portions 14 and 16. A plurality of bolts such as shown at 18 maintain the two halves 14 and 16 securely together.

Rotatably mounted within the housing 12 is a horizontally arranged drum shaft 20. Bearings 22 and 24 allow the shaft 20 to rotate freely within the housing. Securely mounted on the shaft 20 so as to rotate therewith is a drum 26. A rope or cable 28 is wound about the drum 26 such as shown at 30.

The upper end of the housing 12 includes a handle member 32 including an opening 34 (FIG. 2) which may be utilized to carry or mount the entire device 10 to a support structure such as a bridge or the like.

The lowermost portion of the housing 12 has an opening 36 therein which allows the cable 28 to pass therethrough after the same has been guided to the opening by guide roller 38. Preferably, the rope terminates in a hook, eye or the like for connection to a harness worn by a worker.

Also located within the housing 12 is a spiral spring 40. The outermost spiral of the spring 40 is secured to the housing by a bolt or the like 42 as shown in FIG. 1. The innermost end of the spring 40 is secured to the shaft 20 by a rivet or the like 44. The spiral spring 40 maintains a continuous turning force on the drum shaft 20 and thus the drum 26 so that the cable 28 continuously tends to be wound up upon the drum 26.

Figure 2:
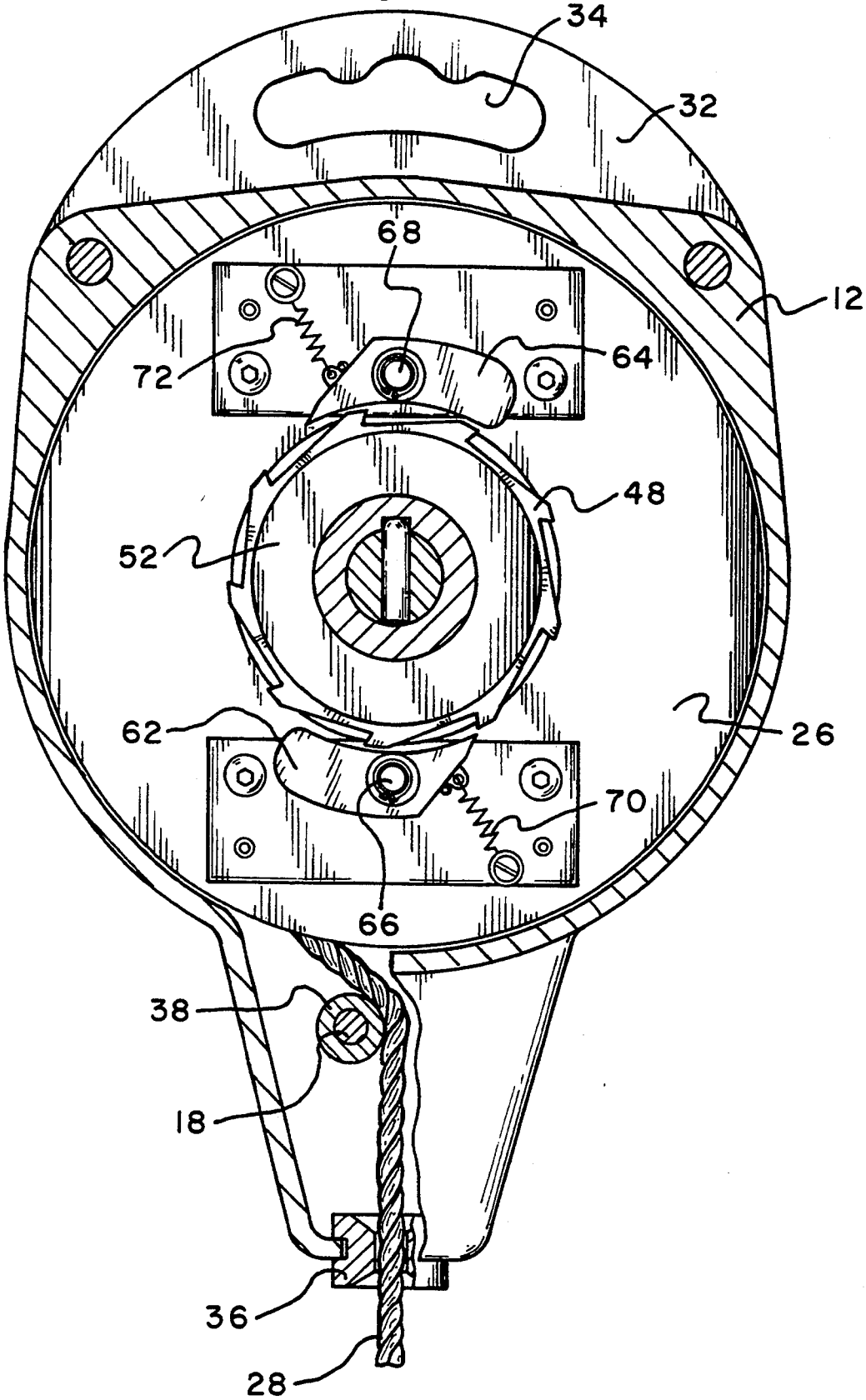
FIG. 2 is a sectional view taken along the line 2—2 of FIG. 1 and illustrating the centrifugal pawl and ratchet of the main braking mechanism.
Figure 4:
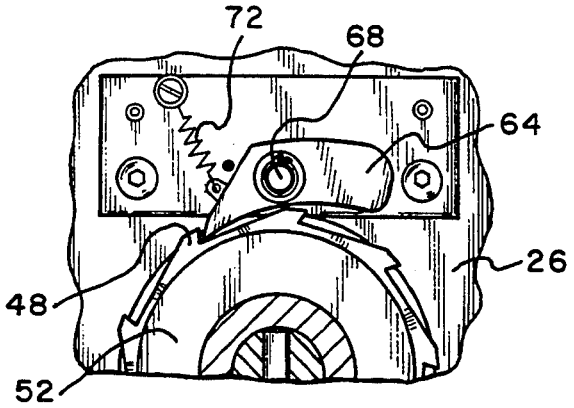
FIG. 4 is a view of a portion of FIG. 2 showing the main centrifugal brake in engagement.
Figure 5:
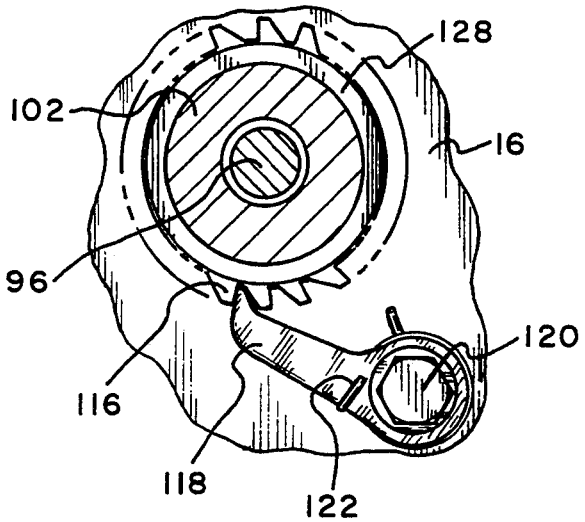

The centrifugal actuated brake mechanism is shown most clearly in FIGS. 1, 2 and 4. The brake mechanism includes a ratchet 48 which is mounted for rotation but is clamped between brake pads or friction disks 50 and 52. The ratchet 48 and disks 50 and 52 are held between the inner wall of the housing part 14 and the undersurface 54 of the bolt 56. Nut 58 maintains the bolt in position and spring 60 provides tension for the brake mechanism which is comprised of the friction disks 50 and 52 and the ratchet 48. Once the proper force or tension is set, pin 46 is inserted into aligning holes in the nut 58 and the housing to prevent further rotation of the nut.

A pair of pawls 62 and 64 are pivotally mounted on one of the outer surfaces of the drum 26 by pivot pins 66 and 68. These pawls are normally maintained in a non-operative position by springs 70 and 72. The pawls 62 and 64 normally rotate with the drum 26 and will remain in the orientation with respect to the drum 26 shown in FIG. 2. However, should the drum rotate very quickly, centrifugal force causes the back end of each of the pawls 62 and 64 to move outwardly thereby causing the forward end of each pawl to engage the ratchet 48 as shown in FIG. 4 and the entire drum 26 then slows down and eventually stops as a result of the forces of the friction disks 50 and 52.

The device thus far described is essentially a conventional safety device such as that shown in U.S. Pat. No. 4,511,123. It operates in a known manner to arrest or brake the fall of a worker to prevent serious injury to him. The following describes that aspect of the present invention which allows a coworker to lift or lower a fallen worker back to a safe location.

The rear end of the drum shaft 20 extends to the left as shown in FIG. 1 and extends through the end wall of the housing portion 16 to the exterior of the housing 12. The central portion of the rear end of the shaft 20 is hollow and contains a vehicle 74 which is axially slidable therein. A compression spring 76 biases the vehicle 74 outwardly. A cap 78 mounted at the end of the drum shaft 20 maintains the vehicle 74 in place. The cap 78 is movable between a first inward position (FIG. 1) wherein the vehicle 74 is moved inwardly against the force of spring 76 and an outer position (FIG. 3) wherein the vehicle moves outwardly by the force of spring 76. The cap 78 may be locked in either of these two positions through the use of a bayonet-type locking mechanism or the like.

Located within the vehicle 74 is a key 80. Key 80 has a first end pivoted to the vehicle through the use of a pivot pin 82 and a second free end 84. The free end 84 is biased axially outwardly through the use of a spring 86.

Figure 3:
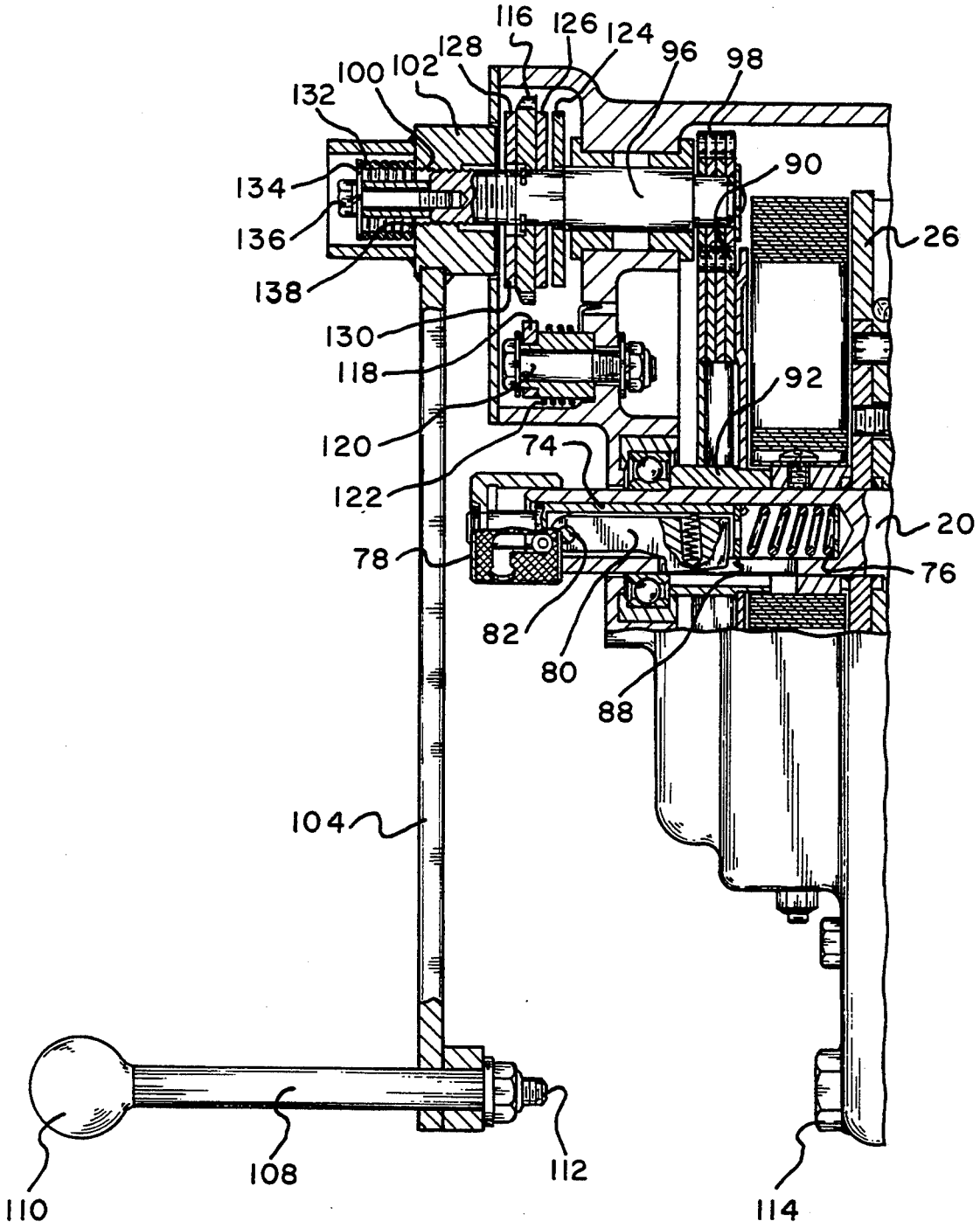
FIG. 3 is a cross-sectional view similar to FIG. 1 illustrating the device in a different state.
Figure 6:
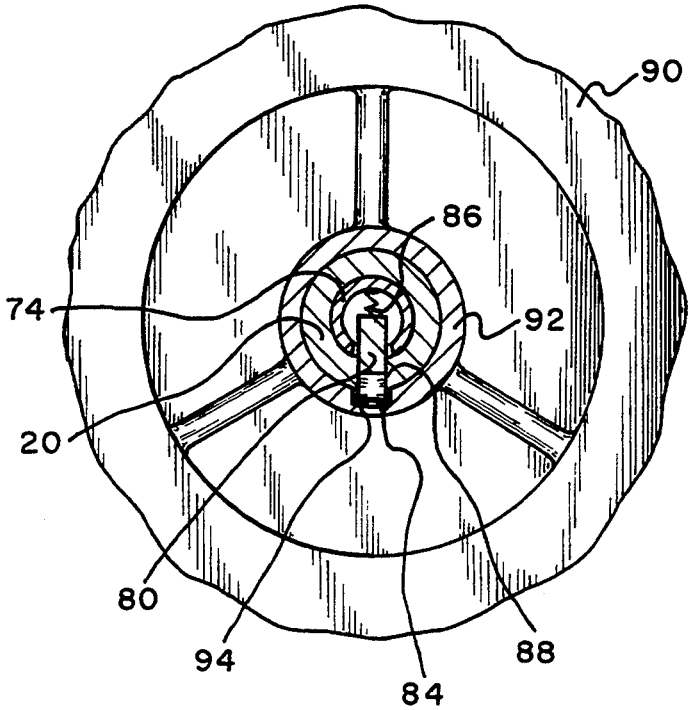
FIG. 6 is a partial cross-sectional view taken through the center portion of FIG. 1.

As shownmost clearly in FIGS. 1, 3 and 6, when the cap 78 is in its outer position (FIG. 3), spring 76 moves the vehicle 74 outwardly and the key 80 is cammed axially inwardly against the force of the spring 86 so as to lie entirely within the confines of the shaft 20. However, when the cap 78 is moved inwardly (FIGS. 1 and 6), pushing the vehicle 74 inwardly against the force of spring 76, the free end of the key 84 moves axially outwardly through the elongated slot 88 in the wall of the drum shaft 20. With the cap 78 in its outer position and the key 80 located within the confines of the drum shaft 20, the device acts as a conventional safety device as described above. Movement of the cap 78 inwardly thereby allowing the free end 84 of the key 80 to pass through the slot 88 activates the lifting or lowering means as will become clearer hereinafter.

Surrounding the drum shaft 20 in the area of the key 80 is a large gear 90. Gear 90 is mounted on a hub 92 for relative rotation around the drum shaft 20. Hub 92 is provided with one or more elongated slots 94 which are complementary to the slot 88 in the shaft 20.

A drive shaft 96 is mounted within the housing 12 and extends outwardly to the exterior thereof. Secured to the inner end of the drive shaft 96 is a small gear 98 which is fixed for rotation with the drive shaft. The small gear 98 meshes with the large gear 90.

The outer surface of the drive shaft 96 that extends outwardly of the housing 20 has a screw thread thereon as shown at 100. A nut 102 is threaded onto the threads 100 of the drive shaft 96. Radially extending from the nut 102 and rigidly secured thereto is an elongated bar 104 which forms part of a crank handle. The free end of the bar 104 includes an aperture 106 therein. A rod 108 having a knob 110 at one end thereof extends through the aperture 106. The other end of the rod 108 has a screw thread thereon such as shown at 112 which can be threaded into the nut 114 mounted on the housing 12 for storage. (See FIG. 1) The rod 108 and bar 104 form a crank handle. When it is desired to use the same, the knob 110 is turned until the end 112 is unthreaded from the nut 114. The rod 108 is then drawn through the aperture 106 to form a crank handle as shown in FIG. 3.

Mounted on the drive shaft 96 is a ratchet 116. Ratchet 116 is mounted so as to rotate relative to the shaft and also for limited axial movement. This ratchet engages a pawl 118 pivotally secured to the post 120 and biased toward the ratchet through the use of spring 122.

Also secured to the drive shaft 96 and spaced slightly from the ratchet 116 is a disk 124. Unlike the ratchet 116, disk 124 is securely fixed to the drive shaft 96 so as to rotate therewith at all times. Located between the ratchet 116 and disk 124 is a friction disk 126. A similar friction disk 128 is located between the other surface of the ratchet 116 and the inner surface 130 of the nut 102.

A compression spring 132 is provided around the free end of the drive shaft 96 so as to provide stability to the nut 102 which is threaded onto the threads 100 of the drive shaft 96. Spring 132 is compressed between the washer 134 secured to the free end of the drive shaft 96 by bolt 136 and the outer surface 138 of the nut 102.

The device thus described operates in the following manner. When it is desired to use the device in its normal manner as a safety device, the cap 78 is moved into its outer position as shown in FIG. 3. In this position, the key 80 is within the confines of the drum shaft 20 so that the gear 90 is free to rotate relative to the shaft 20. In the event that a worker should fall, the safety device functions in a normal manner to arrest or brake that fall through the use of the centrifugal brake described above.

If it is desired to manually raise or lower a worker who has fallen, the cap 78 is moved inwardly and locked in place as shown in FIG. 1. Key 80 is then biased radially outwardly so that the free end 84 passes through the elongated slot 88 in the drum shaft 20. At this point, handle 110 is rotated so as to unscrew the rod 108 from the nut 114 and the handle is drawn outwardly to form a crank handle. The crank handle is then rotated in a clockwise direction. As this occurs, nut 102 threads itself onto the end of drive shaft 96 thereby compressing the friction disks against the disk 124 and ratchet 116. As the drive shaft 96 rotates, gear 98 rotates gear 90 until the free end 84 of the key 80 aligns with and enters one of the elongated slots 94 in the gear hub 92. Further clockwise rotation of the crank handle thereby causes rotation of the drum shaft 20 and the drum 26. This rotation of the drum 26 will release the pawls 62 and 68 and will wind in the cable 28, thereby lifting the fallen worker. Should a force be removed from the crank handle during lifting, the pawl 118, because of its engagement with the ratchet 116, will prevent reverse rotation of the drive shaft 96 which will, of course, function as a brake to prevent rotation of the drum 26 and withdrawal of the rope 28.

Should it be desired to lower the fallen worker rather than to raise him, the foregoing procedure is first initiated. That is, the crank handle is first rotated clockwise as if the worker were to be lifted so as to release the pawls 62 and 64. Once the pawls are released, the crank handle can be rotated slightly in a counterclockwise direction. The pawl 118, however, being in engagement with the ratchet 116 prevents further rotation of the drive shaft 96 and, hence, withdrawal of the rope 128 from the drum 26. Further counterclockwise rotation of the crank handle will tend to unthread the nut 102 from the threads 100 on the drive shaft 96. As this occurs, the compression force will be removed between the disk 124 and the friction disks 126 and 128 and the ratchet 116 thereby allowing slippage therebetween and rotation of the drive shaft 96. This rotation of the drive shaft 96 is caused by the weight of the worker pulling on rope 28 which causes rotation of the drum 26, gear 90 and gear 98. The weight of the worker will force the drive shaft 96 to rotate in the same direction as the direction of rotation of the crank handle and nut 102. As a result, the shaft 96 tends to thread itself back into the nut 102 thereby increasing the tension force between the ratchet 116 and the friction disks 126 and 128 and the disk 124 so that the ratchet 116 and pawl 118 prevent further rotation of the drive shaft 96 and further lowering of the worker. As a result, the worker will be lowered only when the crank handle is being moved in the counterclockwise direction. As soon as the crank handle is stopped, the worker will stop due to the brake mechanism associated with the drive shaft 96.

The present invention may be embodied in other specific forms without departing from the spirit or essential attributes thereof and accordingly reference should be made to the appended claims rather than to the foregoing specification as indicating the scope of the invention.

I claim:

1. A combined safety device and lifting and lowering means comprising:

a housing having a drum and a drum shaft rotatably mounted within said housing;

a cable adapted to be wound around said drum and having one end secured thereto, the other end of said cable being adapted to be connected to a workman;

spiral spring means connected between said drum and said housing so that during unwinding of said cable and rotation of said drum, said spiral spring means is tensioned and during winding of said cable and therefore rotation of said drum in an opposite direction, said spring means is relaxed;

centrifugal first brake means within said housing for preventing rapid rotation of said drum and therefore rapid unwinding of said cable;

a manually operable drive means carried by said housing, said drive means including a drive shaft mounted for rotation and carrying a gear thereon which rotates with said drive shaft and a handle threaded onto said drive shaft and selectively rotatable in first and second directions in order to rotate said drive shaft;

means for selectively connecting said drive means to said drum and for disconnecting said drive means from said drum such that when said drive means is disconnected from said drum, rotation of said drum is not affected by said drive means and when said drive means is connected to said drum, movement of said handle in said first direction rotates said drum so as to wind said cable on said drum and movement of said handle in said second direction allows said cable to unwind from said drum, wherein when said drive means is connected to said drum and said handle is rotated in said second direction, said handle tends to unthread itself from said drive shaft and said drive shaft is rotated by movement of said drum to thereby rethread said drive shaft into said handle, and said drive means further including second brake means for preventing rotation of said drum when said handle is at rest and which allows said drum to rotate to wind or unwind said cable when said handle is moving, said second brake means including a ratchet means and at least one friction disk.

2. The invention as claimed in claim 1 wherein when said handle is rotated in said first direction it directly rotates said drive shaft.

3. The invention as claimed in claim 1 wherein said drive shaft is mounted so as to allow for limited axial movement thereof.

4. The invention as claimed in claim 3 wherein said friction disk is mounted on said drive shaft for rotation therewith.

5. The invention as claimed in claim 4 further including a ratchet gear carried by said drive shaft but capable of rotation relative to said drive shaft, said ratchet gear being mounted directly adjacent said friction disk.

6. The invention as claimed in claim 5 wherein said ratchet gear is forced against said friction disk so as to rotate therewith when said drive shaft rotates in the direction to thread itself into said handle.

7. The invention as claimed in claim 1 wherein said means for selectively connecting said drive means to said drum and for disconnecting said drive means from said drum is comprised of a means for selectively connecting or disconnecting said drive means to said drum shaft.

8. The invention as claimed in claim 7 wherein said means for selectively connecting or disconnecting includes a gear mounted on said drum shaft and means for selectively connecting said gear to said drum shaft for rotation therewith or for disconnecting said gear from said drum shaft to allow for relative rotation therebetween.

9. A combined safety device and lifting and lowering means comprising:

a housing having a drum and a drum shaft rotatably mounted within said housing;

a cable adapted to be wound around said drum and having one end secured thereto, the other end of said cable being adapted to be connected to a workman;

spiral spring means connected between said drum and said housing so that during unwinding of said cable and rotation of said drum, said spiral spring means is tensioned and during winding of said cable and therefore rotation of said drum in an opposite direction, said spring means is relaxed;

centrifugal first brake means within said housing for preventing rapid rotation of said drum and therefore rapid unwinding of said cable;

a manually operable drive means carried by said housing, said drive means including a handle selectively movable in first and second directions;

means for selectively connecting said drive means to said drum shaft and for disconnecting said drive means from said drum shaft including a gear mounted on said drum shaft and means for selectively connecting said gear to said drum shaft for rotation therewith or for disconnecting said gear from said drum shaft to allow for relative rotation therebetween such that when said drive means is disconnected from said drum shaft, rotation of said drum is not affected by said drive means and when said drive means is connected to said drum shaft, movement of said handle in said first direction rotates said drum so as to wind said cable on said drum and movement of said handle in said second direction allows said cable to unwind from said drum;

said drive means further including second brake means for preventing rotation of said drum when said handle is at rest and which allows said drum to rotate to wind or unwind said cable when said handle is moving, and wherein said drum shaft includes a hollow portion including a movable key therein and a slot in the wall thereof, said key being movable between a first position wherein it is entirely within said hollow portion and a second position wherein a part of said key extends through said slot to engage said gear and further including means for moving said key between said first and second positions.

10. The invention as claimed in claim 9 wherein said second brake means includes a ratchet means.

11. The invention as claimed in claim 10 wherein said second brake means further includes at least one friction disk.

12. The invention as claimed in claim 11 wherein said drive means includes a drive shaft mounted for rotation and carrying a gear thereon which rotates with said drive shaft.

13. The invention as claimed in claim 12 wherein said handle is threaded onto said drive shaft and is adapted to rotate said drive shaft when said handle is moved.

14. The invention as claimed in claim 13 wherein said handle is rotated in said first and second directions.

15. The invention as claimed in claim 14 wherein when said handle is rotated in said first direction it directly rotates said drive shaft.

16. The invention as claimed in claim 14 wherein when said drive means is connected to said drum and said handle is rotated in said second direction, said handle tends to unthread itself from said drive shaft and said drive shaft is rotated by movement of said drum to thereby rethread said drive shaft into said handle.

17. The invention as claimed in claim 16 wherein said drive shaft is mounted so as to allow for limited axial movement thereof.

18. The invention as claimed in claim 17 wherein said friction disk is mounted on said drive shaft for rotation therewith.

19. The invention as claimed in claim 18 further including a ratchet gear carried by said drive shaft but capable of rotation relative to said drive shaft, said ratchet gear being mounted directly adjacent said friction disk.

20. The invention as claimed in claim 19 wherein said ratchet gear is forced against said friction disk so as to rotate therewith when said drive shaft rotates in the direction to thread itself into said handle.

* * * * *